US007151428B2

(12) United States Patent
Flood

(10) Patent No.: US 7,151,428 B2
(45) Date of Patent: Dec. 19, 2006

(54) EXTRA HAND SYSTEM

(76) Inventor: Adam Flood, 133 Wells Rd., Northport, NY (US) 11768

( * ) Notice: Subject to any disclaimer, the term of this patent is extended or adjusted under 35 U.S.C. 154(b) by 49 days.

(21) Appl. No.: 10/919,022

(22) Filed: Aug. 16, 2004

(65) Prior Publication Data

US 2006/0033601 A1 Feb. 16, 2006

(51) Int. Cl.
*H01F 7/20* (2006.01)

(52) U.S. Cl. ..... 335/285

(58) Field of Classification Search ..... 335/285–295
See application file for complete search history.

(56) References Cited

U.S. PATENT DOCUMENTS 4,075,589 A * 2/1978 Braillon ..... 335/286
4,777,463 A * 10/1988 Cory et al. ..... 335/289
6,031,209 A * 2/2000 Wiesman ..... 219/447.1
6,489,871 B1 * 12/2002 Barton ..... 335/285
6,636,153 B1 * 10/2003 Barton et al. ..... 340/680
2003/0041740 A1 * 3/2003 Varnhorn et al. ..... 99/330
2005/0269314 A1 * 12/2005 Rael ..... 219/620

* cited by examiner

*Primary Examiner*—Elvin Enad
*Assistant Examiner*—Bernard Rojas
(74) *Attorney, Agent, or Firm*—Leo G. Lenna; Law Office Leo G. Lenna

(57) ABSTRACT

The present application is directed to an apparatus designed to hold an object in a stationary position using electromagnetic components. The object is held in a stationary position when at least one electromagnet is activated and the object is released when the at least one electromagnet is deactivated. The apparatus can be used to hold cooking bowls, pots, pans, and other objects that need to be held in place while being used.

17 Claims, 6 Drawing Sheets

EXTRA HAND SYSTEM

FIELD OF THE INVENTION

The present invention relates to the field of electromagnetic equipment that is easy to activate and deactivate. In particular, the present invention is directed to a surface that has at least one electromagnetic apparatus in direct connection with the surface so that when the electromagnetic apparatus is activated and a metallic item is placed on top of the surface the object is held in place. Once the electromagnetic apparatus is deactivated the object is no longer held in place and can be freely moved.

BACKGROUND OF THE INVENTION

Many different situations arise where an extra set of hands to hold one or more object in place for a given period of time and then release the object when deactivated would be helpful. One particular population that this apparatus would help is the handicap population. Handicapped and/or people whom have lost the use of one or two of their limbs often need an extra hand to accomplish simple everyday tasks such as preparing meals, eating and cleaning up after cooking. Clamps and weighted objects such as weighted pots; bowls and the like have been available for years but are seldom used because these objects are often inadequate for several reasons.

First, weighted pots are either too light to be affective or are too heavy for a handicapped person to lift and carry them in the kitchen. In other words, a lightly weighted frying pan is easily moved when a spatula is used to turn an item cooking in the frying pan. A moving frying pan can cause a fire or burns if it falls off of the stove or hot plate. A similar problem can arise when a weighted bowl is too light. If a handicapped person uses a lightly weighted bowl for mixing, the bowl would move across the counter-top since it is too light to resist movement.

In an effort to compensate for these shortcomings, products have been produced that are much heavier but these products are also laced with problems. In order for a weighted pot to be effective it must be heavy enough to resist movement when force is applied to it during cooking. The same is true for a weighted bowl when used for mixing. However, as stated above a pot or bowl with this much weight is difficult for a handicapped person to manipulate and/or carry.

Another class of products available on the market today that is designed to help the handicapped population secure pots, bowls, and other items in place while cooking uses a clamping system. Clamping systems that are designed to secure pots to a stove during cooking and bowls to a counter or table when eating are cumbersome and hard to use. These apparatus may keep the object from moving once the pot and/or bowl is attached but it is often difficult for a handicapped person to attach the pot or bowl in the first place. Similarly, once the pot or bowl is attached it is usually difficult for a handicapped person to remove the clamping system when done.

In view of the forgoing, what is needed is a apparatus that is able to hold a pot/bowl in place that is easy to attach and detach, that is not too heavy to move or so light that it inadequately anchors an object in place. In other words, what is needed is an apparatus that can hold a pot/bowl in place that does not have the shortcomings of the apparatus described above. The apparatus should be versatile enough so that it can be used in different applications so as to help the handicap, elderly and even children eat, cook, enjoy hobbies and conduct daily chores.

The apparatus of the present invention achieves this goal. The apparatus of the present invention uses electromagnetic power to hold metal-containing apparatus in place when activated and these metal-containing apparatus are released when deactivated. The apparatus can be turned on or off using an actuator switch as simply as an on and off switch, posing less problems for the handicap community than the apparatus described above. The strong electromagnetic force of the present invention is more than adequate to hold the object in place without slipping.

Using electromagnetic technology, the present invention provides a safe, effective way to handle pots, bowls and other objects requiring either more force than that of a single hand or a steady grip. The present invention maybe in the form of an electromagnetic board, stove ring, or plate all of which overcome the shortcomings of the apparatus currently available to the handicapped, elderly and even infant population.

SUMMARY OF THE INVENTION

The present invention is directed to an electromagnetic apparatus that uses electromagnets to hold metal-containing objects in place when activated and these metal-containing objects are released when the electromagnets are deactivated. The electromagnetic apparatus can be turned on or off using an actuator switch which can be as simply as a conventional on and off switch. The strong electromagnetic force of the present invention overcomes the shortcomings of the prior art since the electromagnetic force is more than adequate to hold an object in place without slipping.

One embodiment of the present invention is directed to an electromagnetic apparatus comprising a supporting surface having a top surface and an oppositely disposed bottom surface. The bottom surface of the supporting surface is adapted to rest evenly on a substantially flat two dimensional surface. The top surface of the electromagnetic apparatus comprises at least one electromagnetic element that is in communication with an actuator switch. The actuator switch is also in communication with a power source and can be used to easily turn the power to the electromagnetic elements on and off. Turning the power to the electromagnetic element off turns off the electromagnetic field produced by the powered electromagnets and therefore releases any metallic object that is held on the top surface. Turning the power back on to the electromagnets would once again activate the electromagnetic field and resulting in securing the same metallic object or a new metallic object to the supporting surface.

In one embodiment of the present invention, the electromagnetic apparatus has at least one electromagnetic element that is in communication with the top surface of the supporting surface of the apparatus and at least one other electromagnetic element that is in communication with the oppositely disposed bottom surface of the supporting surface. The electromagnet in communication with the top surface of the supporting surface is designed to attract and hold in place metal objects placed on the top surface when power to the electromagnetic is turned on and releases the metallic object placed on the top surface when power to the electromagnets is turned off. The electromagnet in communication with the oppositely disposed bottom surface of the supporting surface is designed to attract and hold the supporting surface to a stationary surface containing metal.

For example, bottom surface of the supporting surface can be used to attach the supporting surface to a metal stovetop when power to the electromagnets in the bottom surface is turned on. When a pot is placed on the top surface of the attached supporting surface and power to the electromagnets in the top surface is turned on the pot will remain in place while the supporting surface remains attached to the stovetop. This will permit the user to manipulate items in the pot without using a second hand to hold the pot steady. Turning the power off to electromagnet in communication with the top surface of the supporting surface would allow the user to easily remove the pot from the supporting surface while the supporting surface remains attached to the stove top by the powered electromagnets in the bottom surface.

Turning the power off to the electromagnets in the bottom surface of the supporting surface would then allow the user to easily remove the supporting surface from the stovetop for cleaning or storage. The supporting surface used for cooking on a stovetop can be in the shape of a ring so that a cooking flame can pass through the ring to reach the pot. The supporting surface may also take the form of any form selected from the group consisting essentially of a cutting board, a counter cover, a tray, a glass stove top surface, a metallic stove top surface and a hollow ring. Other shapes and configurations not listed above maybe used and are fully anticipated to part of the present invention.

Another embodiment of the invention is directed to an electromagnetic apparatus that has at least one electromagnetic element in communication with the top surface of the supporting surface of the apparatus and at least one other electromagnetic element in communication with the oppositely disposed bottom surface of the supporting surface. As with the previous embodiments the activation and deactivation of the electromagnets will either allow the apparatus to remain attached to a stationary surface or not; or allow a metal containing device placed on top of the surface to remain attached to the top surface or not.

This embodiment also has a metal containing holding device that can be placed upon non-metal containing items that when the electromagnets in the top surface of the apparatus are activated, the non-metal containing items are held in placed by being sandwiched between the metal containing device and the top surface of the apparatus. In other words, placing a carrot on the surface of the apparatus and the metal containing device on top of the carrot, the carrot will be sandwiched in place once the electromagnets in the top surface are activated. This permits the user to cut the carrot while it is held in place.

Still another embodiment of the present invention is directed to a kit for converting a supporting surface into an electromagnetic attaching supporting surface comprising at least one electromagnetic element having an attaching mechanism on one side of the electromagnetic element. The attaching mechanism can be selected from the group consisting essentially of adhesive strips, Velcro®, clamping mechanism, and a turn screw. The kit can be used to convert a non-electromagnetic surface into an electromagnetic surface.

The kit may also containing instructions on how to install and use the kit as well as balancing legs that can be used to balance the surface after an electromagnetic element is added to the underside of an existing surface. The kit may also include a detachable power cord that can be detached from the electromagnetic element when the surface to which it is attached is to be washed.

BRIEF DESCRIPTION OF THE FIGURES

FIG. 1 shows a partial cross section of the electromagnetic surface apparatus of the present invention.

Figure 1:
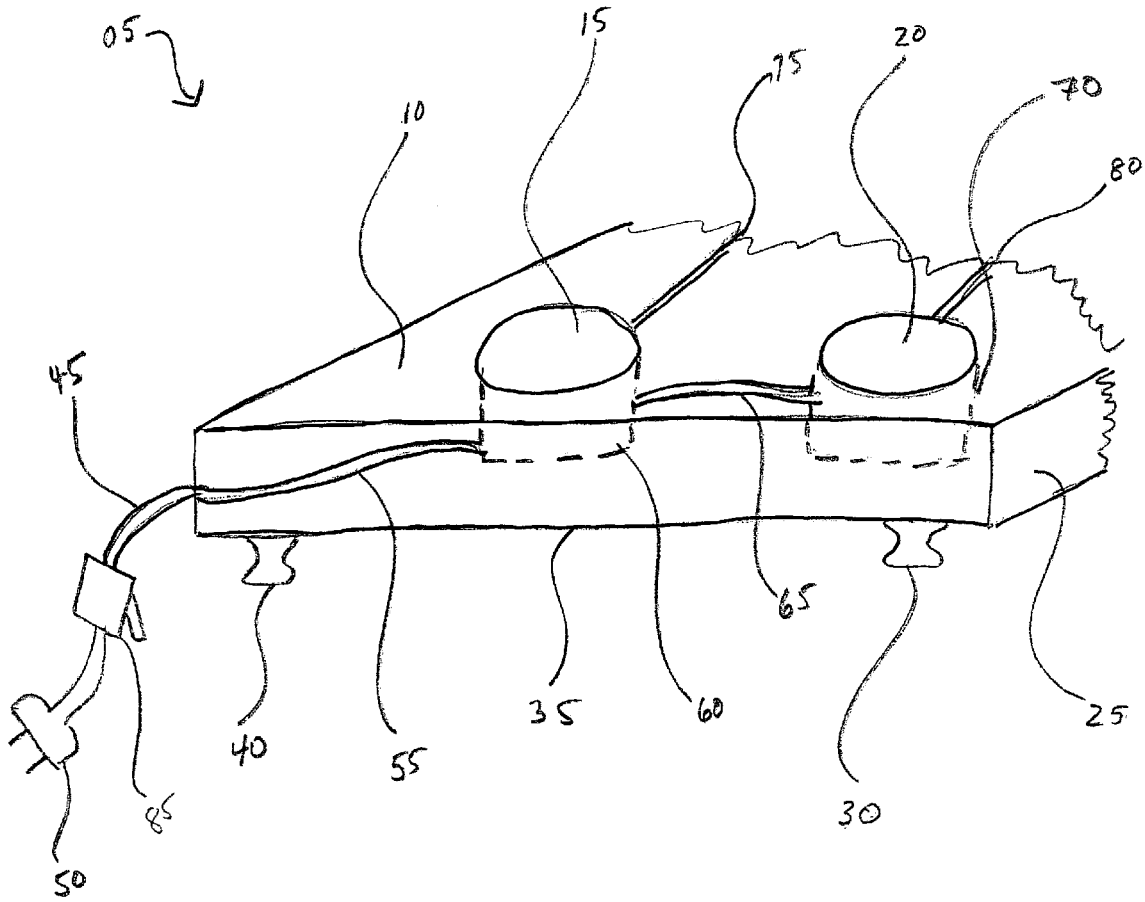
FIG. 1

(05) electromagnetic surface apparatus
(10) top surface
(15) first electromagnet
(20) second electromagnet
(25) side of electromagnetic surface apparatus
(30) leg
(35) bottom surface
(40) leg
(45) power cord
(50) power plug
(55) wire attaching the power cord to the first electromagnet
(60) body of first electromagnet
(65) interconnecting wire
(70) body of second electromagnet
(75) first connector wire
(80) second connector wire
(85) on/off actuator

FIG. 2

Figure 2:
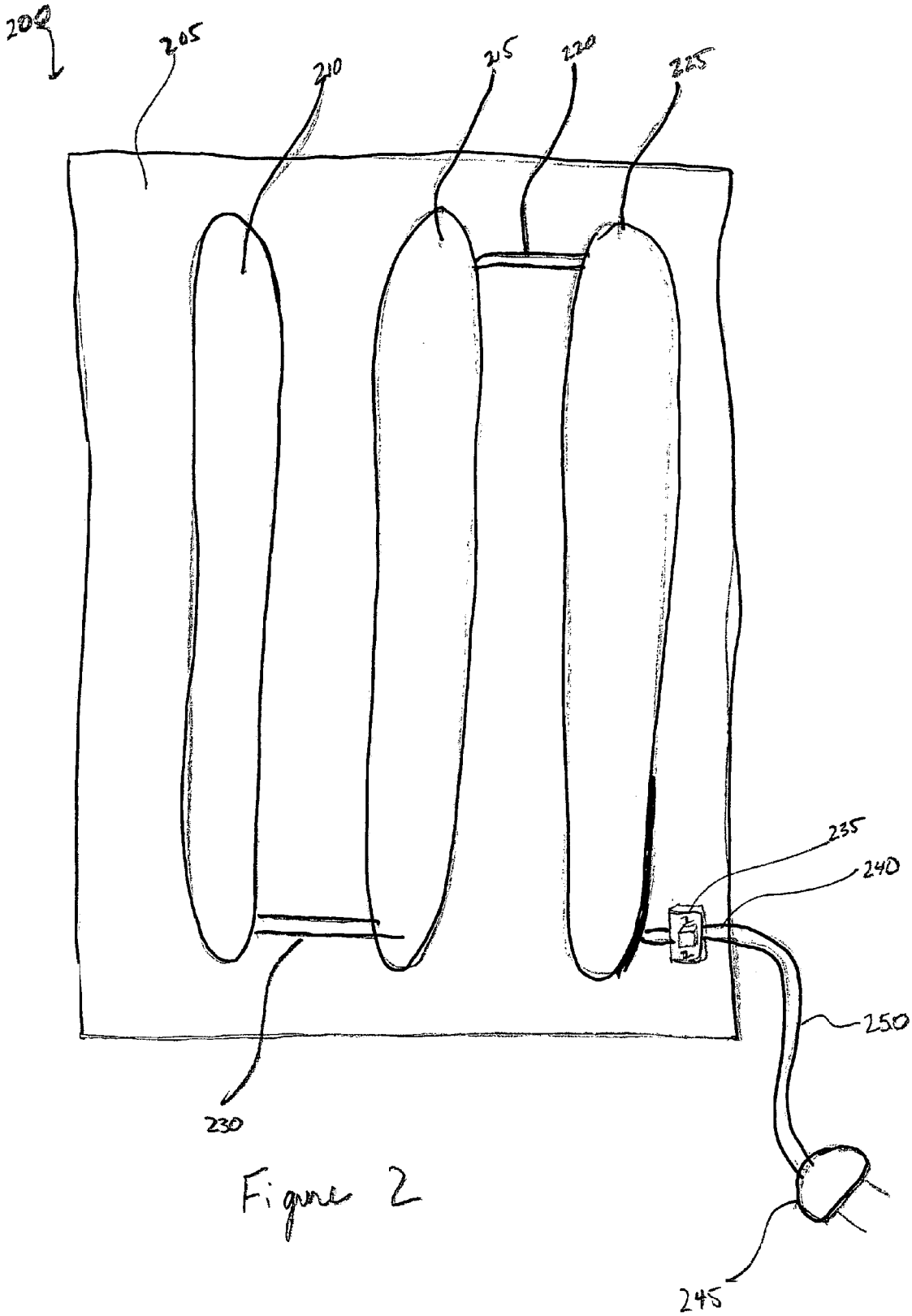

FIG. 2 is shows a top surface of the electromagnetic surface apparatus of the present invention.

(200) electromagnetic surface apparatus
(205) top surface
(210) first electromagnet
(215) second electromagnet
(220) second interconnecting wire
(225) third electromagnet
(230) first interconnecting wire
(235) actuator switch
(240) internal power cord
(245) plug
(250) power cord

FIG. 3

Figure 3:
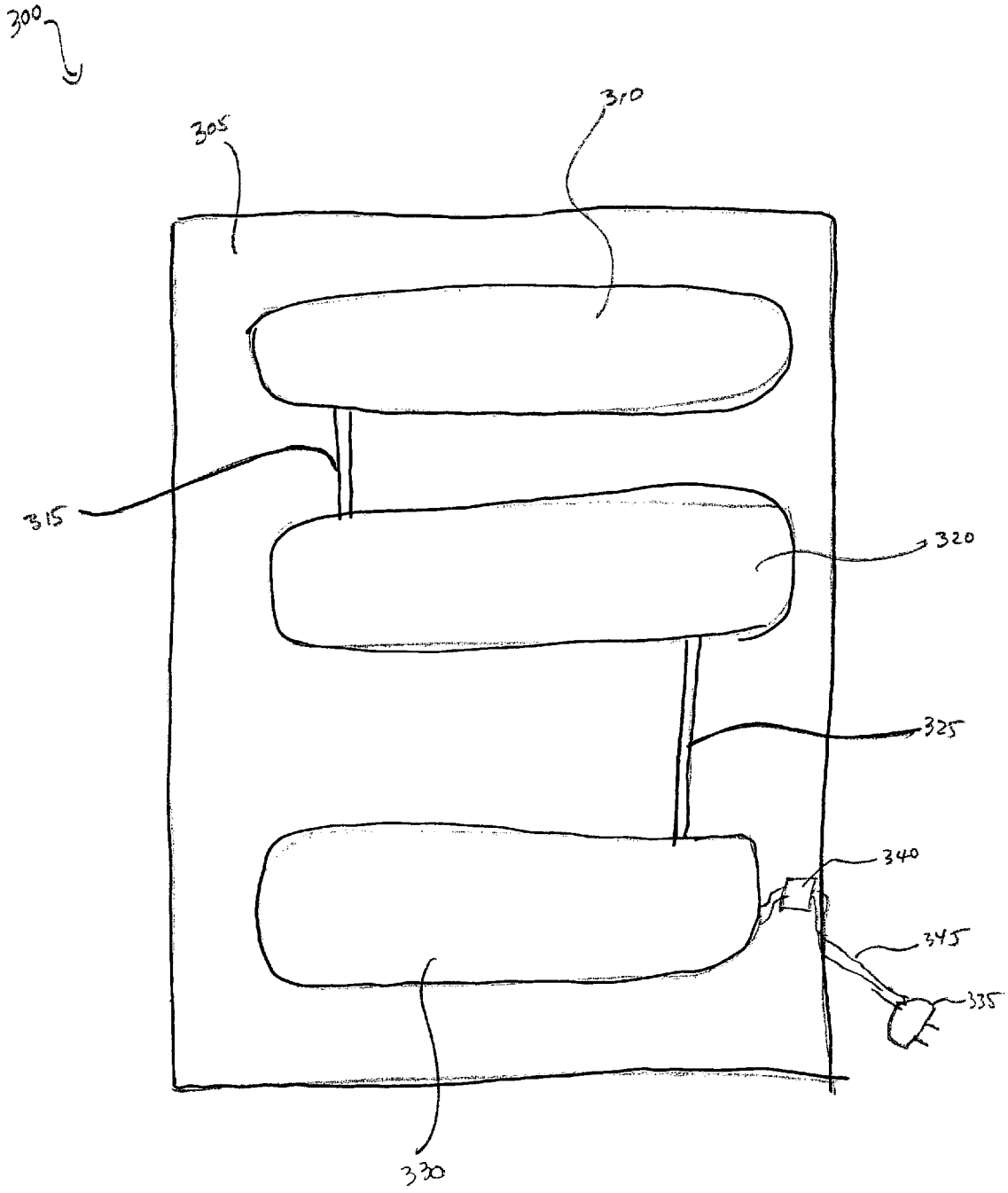

FIG. 3 shows a bottom surface of the electromagnetic surface apparatus of the present invention.

(300) electromagnetic surface apparatus
(305) bottom surface
(310) first electromagnet
(315) first interconnecting wire
(320) second electromagnet
(325) second interconnecting wire
(330) third electromagnet
(335) plug
(340) actuator switch
(345) power cord

FIG. 4

Figure 4:
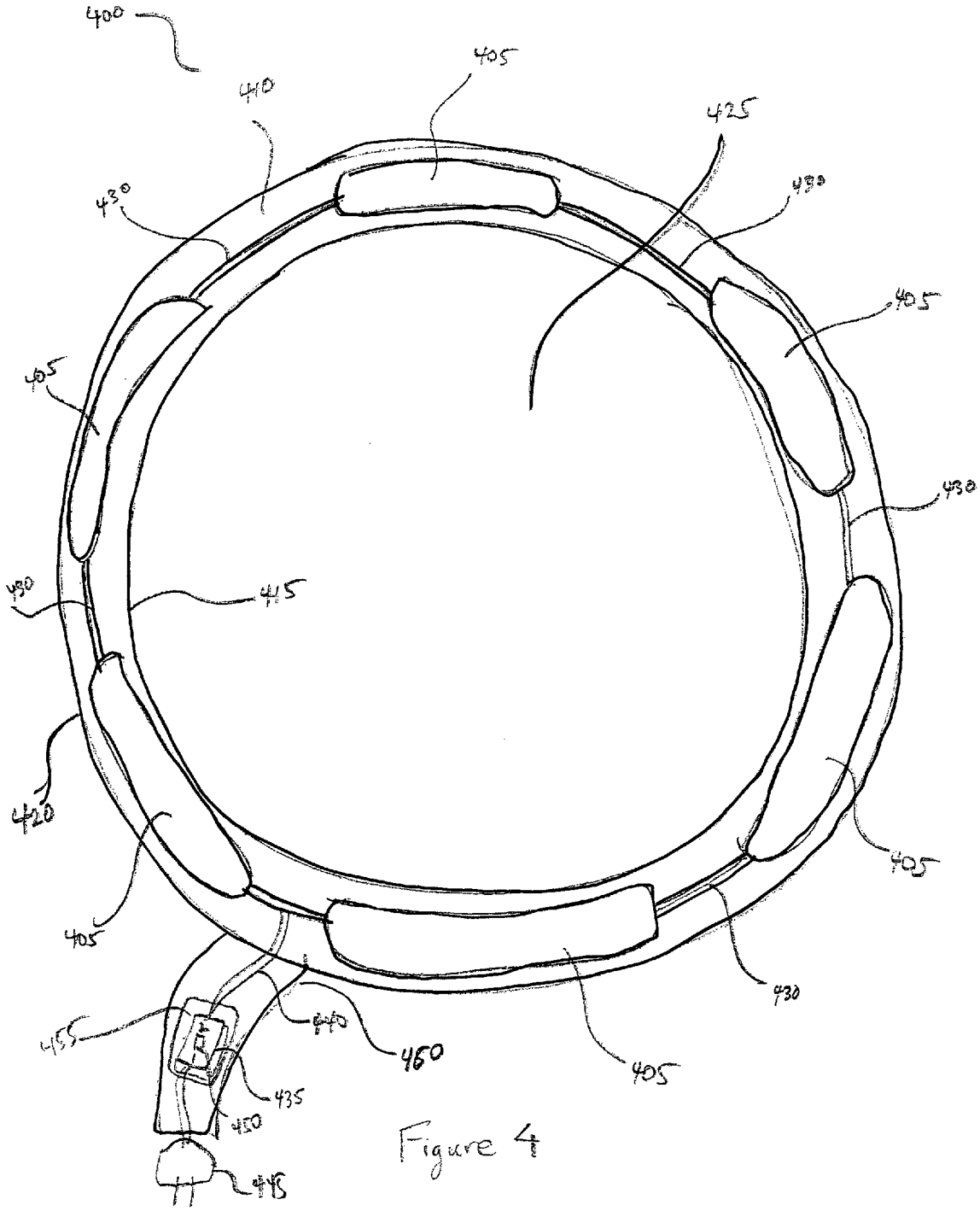

FIG. 4 shows a top surface of a cooking ring electromagnetic surface apparatus of the present invention.

(400) electromagnetic cooking ring
(405) electromagnet
(410) top surface
(415) inner-wall of cooking ring
(420) outer-wall of cooking ring
(425) inner void
(430) electromagnet interconnecting wires
(435) on/off actuator
(440) wire to actuator switch
(445) plug
(450) actuator switch
(455) opening in shield for actuator switch
(460) thermal shield

FIG. 5

Figure 5:
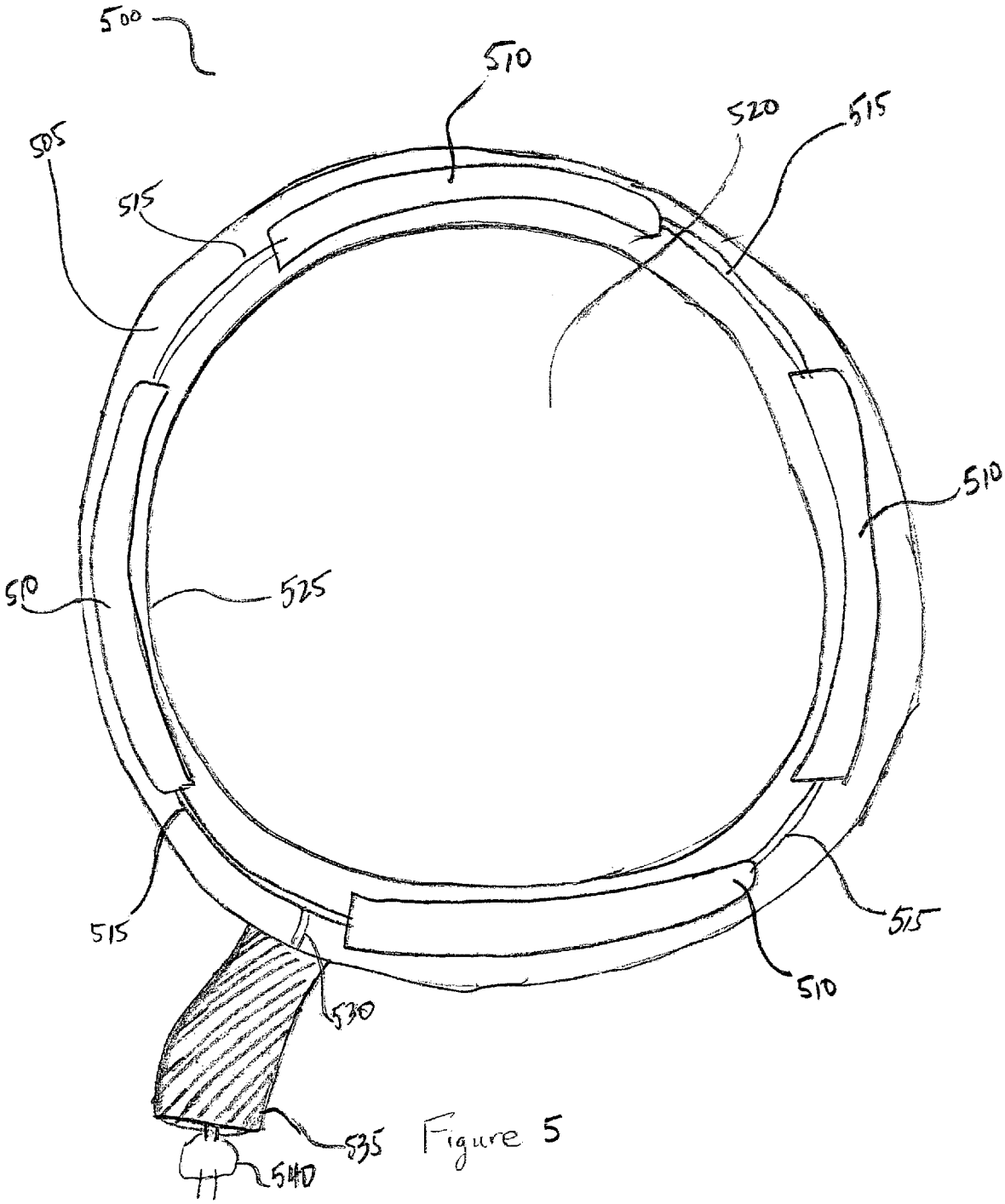

FIG. 5 shows a bottom surface of a cooking ring electromagnetic surface apparatus of the present invention.

(500) electromagnetic cooking ring
(505) bottom surface
(510) electromagnet
(515) electromagnet interconnecting wires
(520) inner void
(525) inner wall
(530) wire to on/of actuator switch
(535) bottom of thermal shield
(540) plug

FIG. 6

Figure 6:
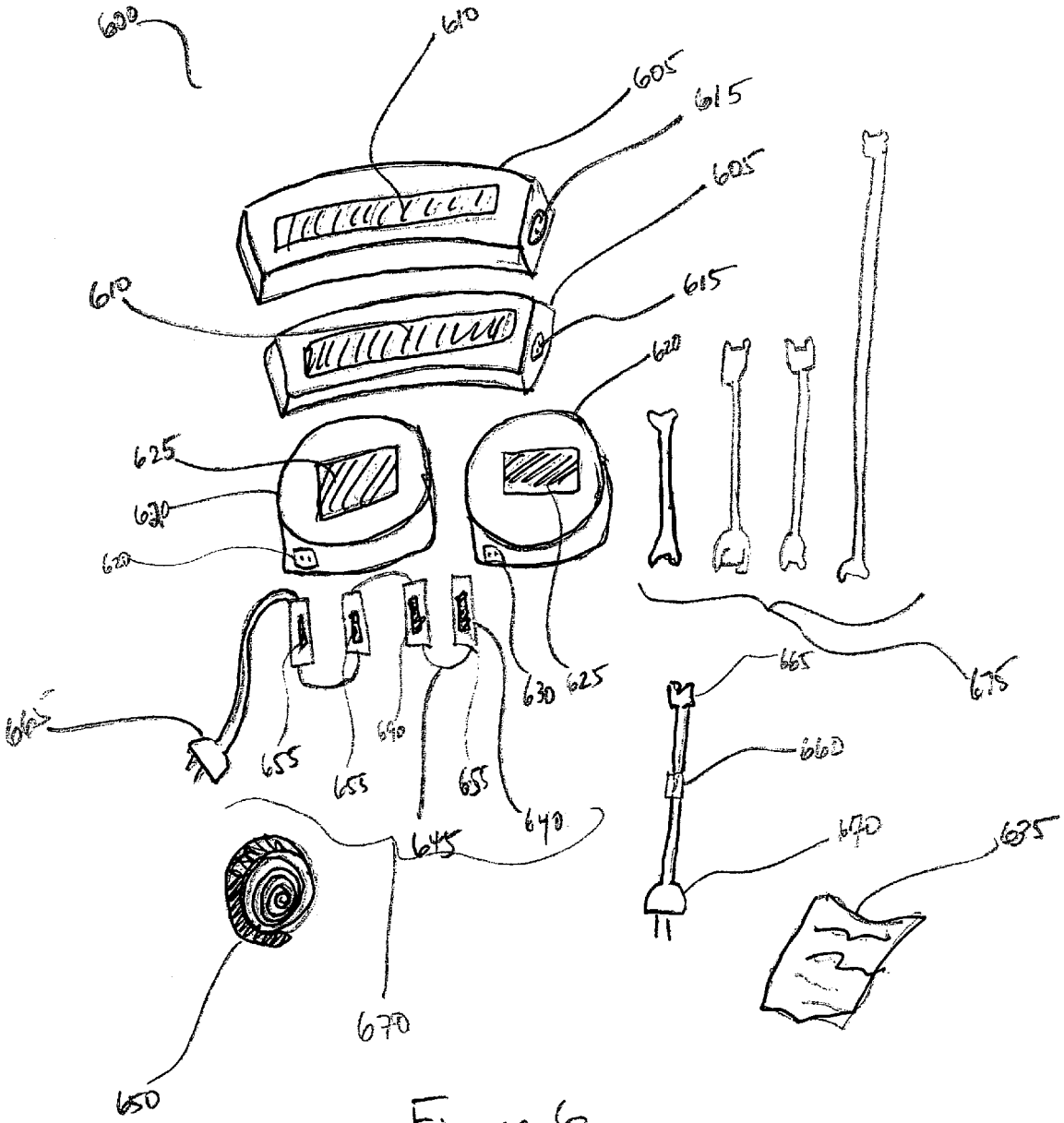

FIG. 6 shows a top view of electromagnetic surface conversion kit.

(600) electromagnetic surface conversion kit
(605) rectangular-shaped electromagnet
(610) Velcro®/adhesive surface
(615) electromagnet interconnecting wire port
(620) round-shaped electromagnet
(625) Velcro®/adhesive surface
(630) electromagnet interconnecting wire port
(635) instructions
(640) small electromagnet connected in series
(645) interconnecting wires
(650) Velcro®/two sided tape roll
(655) Velcro®/two sided tape
(660) On/off actuator switch
(665) interconnect or plug for port
(670) power plug
(675) assorted electromagnet interconnecting wires
(680) interconnecting wires
(685) plug
(690)) Velcro®/adhesive surface
(695) Series of small electromagnets

DETAILED DESCRIPTION OF THE INVENTION

FIG. 1 shows a cross section of one embodiment of the invention. This embodiment is directed to an electromagnetic surface apparatus (05) having a top surface (10) and an oppositely disposed bottom surface (35). The oppositely disposed bottom surface (35) can be equipped with a plurality of legs (40) that can be used to stabilize the surface apparatus on a counter and or other surface in which the apparatus is placed. The legs are also used as grips or anti-slide elements that can be made of rubber like material that will not slide if a lateral force is applied.

Flush with or directly below the top surface (10) of the electromagnetic apparatus (05) is first and second electromagnets (15, 20 respectively). As mentioned above, the body of the first and second electromagnets (60, 70 respectively) is embedded into the electromagnetic surface apparatus (05) so that either the electromagnets are flush with the surface of the apparatus or are countersunk just below the surface. Either way, the electromagnets must be positioned so as to be in communication with any metallic objects placed on the surface.

Although this embodiment only shows two electromagnets it is well within the scope of the invention to have more than two electromagnets dispersed throughout the surface of the electromagnetic surface apparatus (05). The thickness of the electromagnets used in the apparatus is determined in part by the thickness of the side (25) of the electromagnetic surface apparatus (05). The first electromagnet is equipped with a connecting wire (75) and the second electromagnet is equipped with a second connecting wire (80) that can be used to connect additional electromagnets in series.

The electromagnets are attached to each other using an interconnecting wire (65). The first electromagnet is connected to power cord (45) via interconnecting wire (55). At the end of the power cord (85) is a conventional wall outlet plug (50). The power is turned on and off using the on/off actuator switch (85). Although this embodiment shows a power cord that can be plugged into a wall outlet the apparatus can also be adapted to run on 9 or 12-volt batteries. The number of batteries required to operate the electromagnets is dependent on the number of electromagnets being powered.

Once actuator switch (85) is turned to the on position power is supplied to the electromagnet via power cord (45) and interconnecting wires (55,65,75 and 80). Once power is supplied to the electromagnets to form an electromagnetic filed, these electromagnets are able to attract and hold metal objects. For example, if a metal pot or bowl is placed on to the top surface (10) of the electromagnetic surface apparatus (05) of the invention when activated the pot will be held in one place due to the electromagnetic attraction. Once the on/off actuator switch (85) is turned to the off position power is no longer supplied to the electromagnets. With no power being supplied to the electromagnets and they lose their electromagnetic filed and therefore their ability to attract metallic objects. In other words, the metal pot or bowl that was being held in a single position can now is freely moved form one place to another.

Turning the power on and off will determine whether an object will be held in a place or not. This apparatus is extremely useful for handicapped people that are not able to hold an object in place while using the object. For example, a handicapped person that only has use of one arm may find it difficult to stir or mix food in a bowl since the mixing action will certainly move the bowl from one place to another if it is not held down. The present invention will hold the bowl down during mixing and when power is shut off to the electromagnets will allow the bowl to be removed. The actuator switch (85) shown is just one way that the power can be turned on and off to the electromagnets of the apparatus. However, the invention is not limited to this depiction. For example, a voice-activated switch, foot peddles, sound activated switch, as well as other types of switches can be used to turn the power on or off to the electromagnetic surface apparatus therefore making it easier to use. All of these apparatuses although not shown are intended to be part of the present invention.

In addition to the above, the apparatus can also come equipped with a metal containing holding device that can be used to sandwich items to the top surface of the apparatus so as to hold the items in place. This can be used to hold vegetables in place so as to make it easier for the user to cut peel or dice them. The device can also hold non-food items in place so that the user can work on them. For example, the metal containing holding device can be used to sandwich a small model car to the surface of the device so that it can be painted or assembled as a hobby. Although only two illustrative examples are given for the utility of the metal containing holding device and the electromagnetic apparatus many more uses are possible. The metal containing holding device provides a new dimension to the invention allowing non-metallic items to be held in place effectively and released with the flip of the power switch.

The apparatus may also comprise a heating element so that it may operate directly out of the box. In other words, the apparatus may be equipped with a controllable cooking element that can be set for different temperatures and also enjoys all of the features discussed above. Having a cooking device that is able to attach to a surface so that utensils can be used for cooking without the apparatus moving when force is applied will be helpful for people with disabilities and the like. Heating elements can be used in each of the described embodiments and are anticipated as falling within the scope of the invention.

FIG. 2 shows a cross section of the top surface of the electromagnetic surface apparatus of the present invention. The electromagnetic surface apparatus (200) having a top surface (205) with elongated electromagnets embossed below the surface. The first electromagnet (210) is connected to the second electromagnet (215) via a first connecting wire (230) and the second electromagnet (215) is connected to the third electromagnet (225) via interconnecting wire (220). Connected to the third electromagnet (225) is an actuator switch (235) that controls the power to the electromagnets of the invention.

The actuator switch (235) can be as simple as an on/off button or can be a variable intensity switch that is able to adjust the amount of power sent to the electromagnets and therefore control the intensity of the electromagnetic field that is created by the electromagnets. Varying the electromagnetic field of the electromagnets will vary the attracting ability of the electromagnets to metal objects. In other words, setting the actuator switch to full strength will produce a full electromagnetic field and therefore maximally attract metal objects to the surface. The inverse is also true, namely, setting the actuator switch to the lowest setting would produce the smallest amount of magnetic field and therefore only minimally attract metal objects placed on the surface. Finally, placing the actuator switch to the off position will send no power to the magnetic field and therefore produced no magnetic filed. Once the magnetic filed is shut off the metal objects placed on the surface can freely move about the surface.

Connected to the actuator (235) is a power cord (250) that terminates with a plug (245) that is used to connect the apparatus to a wall receptacle. In the alternative, the electromagnetic surface apparatus of the present invention can be power by battery and be totally portable. Although this embodiment shows a specific design and arrangement and number of electromagnets it is within the scope of the present invention to use a different number, size and arrangement of electromagnets. In addition, although the preferred embodiment of the present invention uses electromagnets because of the durability and ability to be turned the magnets on and off, it is also within the scope of the present invention to use regular magnets to produce a similar apparatus.

The apparatus using the regular magnets would not be able to be turned on and off but would be able to hold metal objects in place. This apparatus may be more suitable for use with a baby bowl. For example, a supporting surface having grips on the underside of the surface and regular magnets on the top surface can be used to hold a metal baby bowl in place while the baby is learning to feed him or herself. Therefore, a magnetic surface using non-electromagnets is within the scope of the present invention.

FIG. 3 shows a surface view of the oppositely disposed bottom surface of the electromagnetic top surface describe and shown in FIG. 2. This view of the electromagnetic surface apparatus (300) having a bottom surface that is oppositely disposed to the top surface shown in FIG. 2 has three electromagnets embossed in its surface. The first electromagnet (310) is connected to the second electromagnet (320) via a first connecting wire (315) and the second electromagnet (320) is connected to the third electromagnet (330) via interconnecting wire (325). Connected to the third electromagnet (330) is the actuator switch shown in FIG. 2 that controls the power to the electromagnets of the invention. As stated above this switch can be used to turn on power to the electromagnets in the top surface but also can be used to turn on power to the electromagnets in the bottom surface (300). Having the capability of turning on the power to electromagnets in the top side only, the bottom side only or both is a great feature since it allows an electromagnetic apparatus having electromagnets on both surfaces of the apparatus to be used in different places.

For example, if the apparatus is placed on a metal containing surface and both the top and bottom side electromagnet is are activated then the surface will be attracted to the stationary surface and stay in place while the top surface will hold any metal objects place on top of the surface. If the apparatus were used on a non-metallic surface then the apparatus would stay in place using some type of friction grip. The top surface however, once activated would hold any metal objects it comes in contact with.

This two-sided electromagnetic concept is used and is shown in FIG. 4. FIG. 4 shows the top surface of a cooking ring. The electromagnetic cooking ring (400) has a plurality of electromagnets (405) dispersed on the top and bottom surfaces. As with the other embodiments, the electromagnets (405) are inter-connected by electromagnet connecting wires (430). At least one of the connecting wires (430) is connected to a wire that goes to an on/off actuator (435) having a push button switch (450). A wire form the actuator (435) ends with a plug (445) to attach to a power supply.

The push button switch (450) can be designed to be in the off position one side and the on position on the other side and both on and off when depressed in. What task the operator wishes to accomplish with the cooking ring would determine which mode the actuator would be set in. For example, if the cooking ring were used on a conventional stove where the surface of the stove is constructed out of porcelain-covered metal, turning the top surface electromagnets on the top surface (410) and the bottom surface (shown in FIG. 5) would attach the ring to the stove. This would allow the user to attach a metal pot the top surface (410). This would enable a person to use only one limb when stirring or moving food around in the pot since no hands would be needed to keep the pot in place.

The cooking ring has an inner void (425) that is defined by an inner wall (415). The size of the ring can vary but has a diameter slightly larger than the diameter of a convention stove burner. Having a larger diameter than the stove's burner would allow the ring to be placed over the burner and flames to flow through the center void of the ring. Placing a pot on the ring would allow contact with the electromagnetic top surface (410) of the apparatus but also allow flames to heat the pot for cooking. Once the cooking is done the actuator switch can shut off power to the electromagnets on the bottom side so that it releases from the stove and the complete apparatus with the pot attached is removed. Once off the stove, the electromagnets on the top surface can be deactivated and the pot removed form the cooking ring for cleaning.

If the person using the cooking ring desires to cook something else, then only the top electromagnets would be deactivated and the pot can be removed and replaced with another pot. Once the new pot is placed on the ring then the electromagnets on the top surface are activated again and the pot is secured to the cooking ring. Since the electromagnets located in the bottom were not deactivated when the top electromagnets were, the cooking ring remains attached to the stove and the operator can star to cook once again.

The electromagnetic cooking ring (400) of the present invention may also have a thermal coating on the outside wall of the cooking ring (420) so as to retain heat for better cooking and to prevent potential burns. In addition, the wire and the power cord used in the cooking ring may be wrapped with thermal material to prevent damage. In particular, a thermal shield (460) may be used on the power code extending from the ring to prevent it from being damaged by an open flame.

Although the cooking ring is shown having a circular configuration, other shapes are intended to be part of the invention. For example, for stoves having a square-cooking grate a square-cooking ring would be used. In addition, although the cooking ring is described using electromagnets, non-electromagnetic magnets can be used to replace the electromagnets described above either in total or in part. For example, if a person wants to use the cooking ring all the time, then having strong non-electromagnets in the bottom surface of the cooking ring that attaches to the surface of the stove may be used. Using the permanent magnets would allow the cooking ring to always be attached to the surface or until it is pried lose. Having electromagnets in the top surface that can be activated and deactivated would allow metal pots to be removed for cleaning when the electromagnets are deactivated.

In alternative embodiments the cooking ring can be battery powered, have a variable power switch in place of the actuator shown, or have a different magnet design. For example, if the cooking ring was to be used on a hot plate or glass top stove the cooking surface may or may not be metal. However, it is most likely that metal would be located in close proximately to the cooking surface and a cooking ring having electromagnets that reach this metal surface can be designed. These embodiments as well as the ones described immediately above are clearly within the scope of the invention.

FIG. 5 shows a surface view of the bottom surface of a cooking ring that is oppositely disposed to the top surface shown in FIG. 4. The bottom surface (500) like the top surface shown in FIG. 4 has electromagnets (510) dispersed throughout the rings that are interconnected by interconnecting wires (515). One of the interconnecting wires is in electrical communication with the power cord that may be shrouded in a thermal shield (535) for heat protection. The cord ends with a power cord (540). The contour of the inner wall (525) would follow the contour of the top surface to provide the same inner void (520) for flames to flow through for cooking.

For already existing surfaces that are not electromagnetic but would better serve a handicapped individual if they were retrofitted with electromagnets, the electromagnet kit (600) can be used. FIG. 6 shows a top view of a kit containing the necessary parts needed to convert most non-electromagnetic surfaces into an electromagnetic surface. For example, using the electromagnet kit (600) an ordinary counter-top can be converted into an electromagnetic counter top.

The electromagnetic kit (600) may include at least one rectangular-shaped electromagnet (605) having an adhesive or Velcro® strip (610) for attaching to a apparatus and/or surface as well as an electromagnetic interconnecting wire port (615) that can be used to connect several electromagnets in series. The kit may also contain at least one round electromagnet (620) having an adhesive or Velcro® strip (610) for attaching to an apparatus and/or surface as well as an electromagnetic interconnecting wire port (630) that can be used to connect several electromagnets in series.

The kit may also include a series of smaller electromagnets connected in series (665). The series (690) contains electromagnets (630) that are interconnected by interconnecting wire (655) and the last electromagnetic in the series contains a power cord with plug (685) to attach to a conventional power supply. The kit may also include an assortment of electromagnetic interconnecting wires (675) and a separate power cord having and actuator switch (660) a plug to plug into an inter-connector port (665) and a plug (670) to use in a conventional power source. Using the provided instructions (635), the kit maybe used to convert an ordinary counter top into an electromagnetic counter top that can hold metal objects in place when activated and allow metal objects to move freely when deactivated.

While the invention has been illustrated and described with respect to specific illustrative embodiments and modes of practice, it will be apparent to those skilled in the art that various modifications and improvements may be made without departing from the scope and spirit of the invention. Accordingly, the invention is not to be limited by the illustrative embodiment and modes of practice.

What is claimed is:

1. An electromagnetic apparatus comprising:

a supporting surface having a top surface and an oppositely-disposed bottom surface, said bottom surface adapted to rest on a substantially flat two dimensional surface;

at least one electromagnetic element in direct communication with said supporting surface, said electromagnetic element positioned so that an item placed on top of said supporting surface is influenced by said electromagnetic element;

an actuator switch in communication with a power source to turn power on and off to said electromagnetic element; and a metal containing holding device having a top surface, bottom surface and corresponding sides magnets within said holding device in communication with said support surface.

2. The electromagnetic apparatus according to claim 1 wherein said supporting surface is a two-dimensional sheet-like base having a front edge portion and a rear edge portion, having a top surface and an oppositely-disposed bottom surface, said oppositely-disposed bottom surface adapted to rest on a substantially flat two-dimensional surface.

3. The electromagnetic apparatus according to claim 2 wherein at least one electromagnetic element is in communication with said top surface of said supporting surface and at least one electromagnetic element is in communication with said oppositely disposed bottom surface of said supporting surface.

4. The electromagnetic apparatus according to claim 3 wherein said supporting surface is selected from the group consisting of a cutting board, a counter cover, a tray, a glass stove top surface, a metallic stove top surface and a hollow ring.

5. The electromagnetic apparatus according to claim 3 wherein said supporting surface is in the shaped of a ring so that when said ring is placed around a burner on a stove a metallic pot placed on top of said supporting surface is in direct communication with said ring and a flame from said burner.

6. The electromagnetic apparatus according to claim 5 further comprising a clamping system that secures said supporting surface to an object.

7. The electromagnetic apparatus according to claim 1 wherein the switch is a variable intensity switch.

8. A kit for converting a supporting surface into an electromagnetic attaching surface comprising:

at least one electromagnetic element having an attaching mechanism on one side of said electromagnetic element;

an actuator switch in communication with a power source to turn power on and off to said electromagnetic element; and a metal containing holding device having a top surface, bottom surface and corresponding sides magnets within said holding device in communication with said support surface; and instructions on how to install and use said kit.

9. The kit for converting a supporting surface into an electromagnetic attaching surface according to claim 8 further comprising:

balancing legs for balancing said supporting surface once said at least one electromagnetic element is attached to said supporting surface; and a detachable power cord.

10. The kit for converting a supporting surface into an electromagnetic attaching surface according to claim 8 wherein said electromagnetic element further comprises an attaching means for attaching said electromagnetic element to said supporting surface.

11. The kit for converting a supporting surface into an electromagnetic attaching surface according to claim 10 wherein the attaching means for attaching said electromagnetic element to said supporting surface is selected from the group consisting of adhesive strips, Velcro®, clamping mechanism, and turn screw.

12. The electromagnetic apparatus of claim 1 wherein the magnets are electromagnets.

13. The kit for converting a supporting surface into an electromagnetic attaching surface according to claim 9 further comprising a metal containing holding device having a top surface, bottom surface and corresponding sides.

14. The electromagnetic apparatus of claim 1 further comprising a heating element.

15. The electromagnetic apparatus of claim 14 further comprising a control means for said heating element.

16. The electromagnetic apparatus of claim 1 further comprising a heating element.

17. The electromagnetic apparatus of claim 16 further comprising a control means for said heating element.

* * * * *